United States Patent [19]

Taylor

[11] 4,280,336

[45] Jul. 28, 1981

[54] PORTABLE COOLER WITH FOOD RECEPTACLE

[75] Inventor: Frank Taylor, LaSalle, Canada

[73] Assignee: Holbro A.G., Zug, Switzerland

[21] Appl. No.: 129,755

[22] Filed: Mar. 13, 1980

[51] Int. Cl.[3] ..... F25D 3/08; F25D 3/10

[52] U.S. Cl. ..... 62/457; 62/371; 62/529; 206/541; 206/545; 220/902

[58] Field of Search ..... 206/545, 541; 220/902, 220/1BC; 62/457, 529, 530, 371, 372

[56] References Cited

U.S. PATENT DOCUMENTS

| | | | |
|---|---|---|---|
| 1,015,455 | 1/1912 | Neesham | 206/541 X |
| 2,030,899 | 2/1936 | Schurlock | 62/457 X |
| 2,427,230 | 9/1947 | Salzmann | 62/457 X |
| 3,026,995 | 3/1962 | Slaughter | 206/541 |
| 3,401,535 | 9/1968 | Palmer | 62/457 |
| 3,436,932 | 4/1969 | Paquin | 62/457 |
| 3,605,435 | 9/1971 | Taylor | 62/457 |
| 4,172,365 | 10/1979 | McClintock | 62/457 X |

*Primary Examiner*—Lloyd L. King

*Attorney, Agent, or Firm*—Oblon, Fisher, Spivak, McClelland & Maier

[57] ABSTRACT

A small portable cooler for carrying cylindrical type beverage containers and foodstuff. A handle is integrally molded with the body of the cooler so that it can be carried by one hand. A cold pack is supported in a coolant chamber which distributes cold air to the cylindrical container compartments within the cooler body. A food container is removably secured to a back wall of the container body. The back wall also serves as a support surface for the beverage containers about the food container.

13 Claims, 6 Drawing Figures

Fig. 5
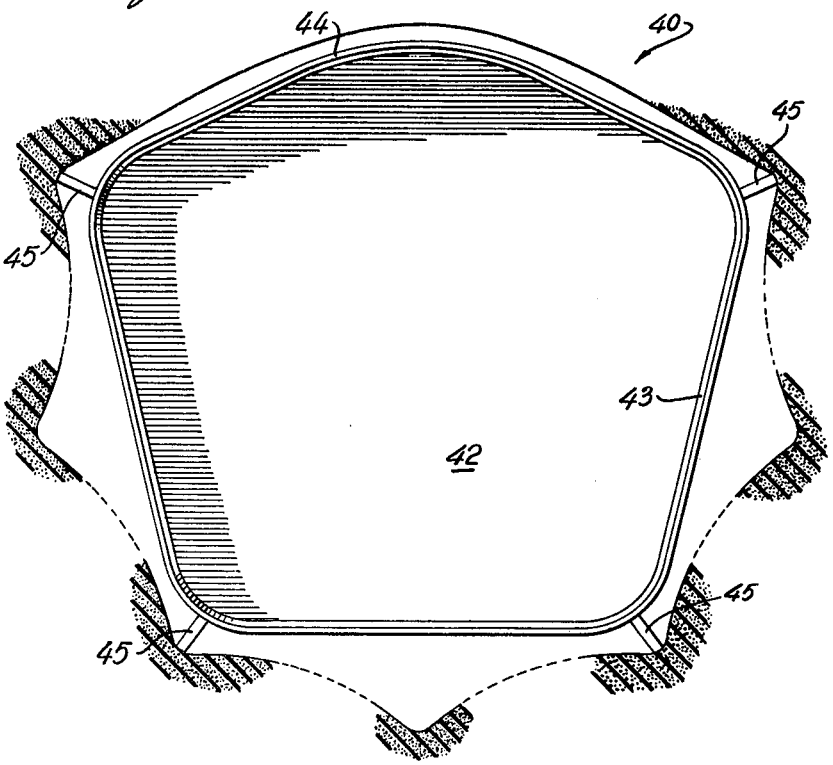
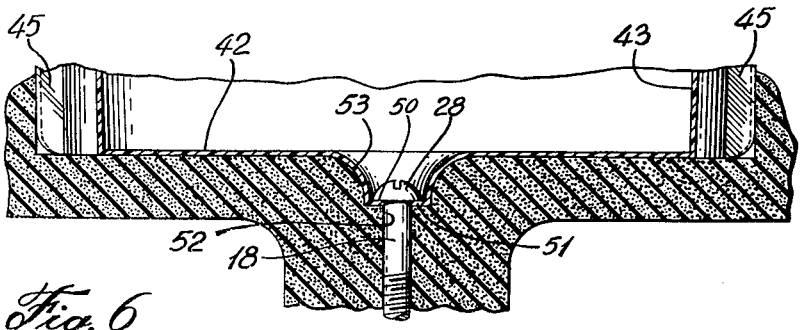
Fig. 6

PORTABLE COOLER WITH FOOD RECEPTACLE

BACKGROUND OF INVENTION (a) Field of the Invention

The present invention relates to a small portable cooler of the type that is refrigerated by a cold pack and having integrated therewith a food receptacle, with the food receptacle being accessible from outside the cooler.

(b) Description of Prior Art

More specifically, the cooler of the present invention is of the type as described in my U.S. Pat. No. 3,605,435 issued on Sept. 20, 1971. This type of cooler requires a cold pack of sufficient size located in a central portion of the cooler to distribute cold air amongst a plurality of cylindrical type cavities positioned thereabout. Cylindrical beverage containers are retained in these cavities. Such coolers are quite compact in design and any free space therein is minimized whereby to maximize on the number of beverage containers that can be stored therein, and the size of the cold pack to have sufficient cold air for distribution to cool the beverage containers.

SUMMARY OF INVENTION

It is a feature of the present invention to provide an improved type of such coolers wherein a food receptacle is integrated with the cooler and made accessible from the outside of the cooler whereby no cold air is lost during access thereto.

Another feature of the present invention is to provide a food receptacle that is removably securable to the cooler and which does not create obstructions to the exterior surface of the cooler.

Another feature of the present invention is to provide a food receptacle in association with the cooler back wall whereby the back wall may be used as a support surface by placing the cooler upside down on a ground surface with the food container exposing foodstuff therein for access.

Another feature of the present invention is to provide a cooler, of the aforementioned type, and which is relatively inexpensive to produce and molded from foam material.

According to the above features, from a broad aspect, the present invention provides a cooler comprising a first section and a second section. A plurality of spaced compartments arranged about a chamber within the first section. Each compartment is in communication with the chamber. An access passage is provided in the second section. Means is also provided for mounting the second section on the first section for relative rotation of the second section relative to the first section about an axis on the center of the central chamber. A pillar is concentric with the axis in the first section. A coolant container is provided and having an aperture therein. The coolant container is receivable in the central chamber with the pillar extending in the aperture. The first section also has a central cavity in a bottom wall thereof to define a food receiving opening in its outer bottom surface.

According to a further broad aspect, a food receptacle is retained in the central cavity.

BRIEF DESCRIPTION OF DRAWINGS

A preferred embodiment of the present invention will now be described with reference to the example thereof illustrated by the accompanying drawings in which:

FIG. 5 is a plan view showing the food receptacle in position in the cooler bottom wall central cavity; and FIG. 6 is a fragmented section view showing a modified version of the bottom wall of the food receptacle and its attachment to the central cavity of the bottom wall of the cooler.

DESCRIPTION OF PREFERRED EMBODIMENTS

Figure 1:
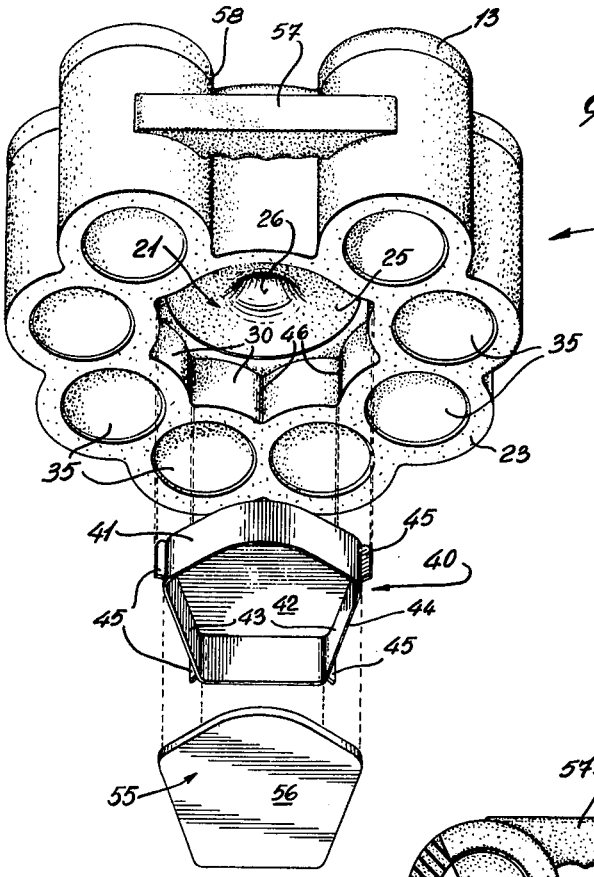
FIG. 1 is an exploded perspective bottom view of my cooler showing the location of the food receptacle.
Figure 2:
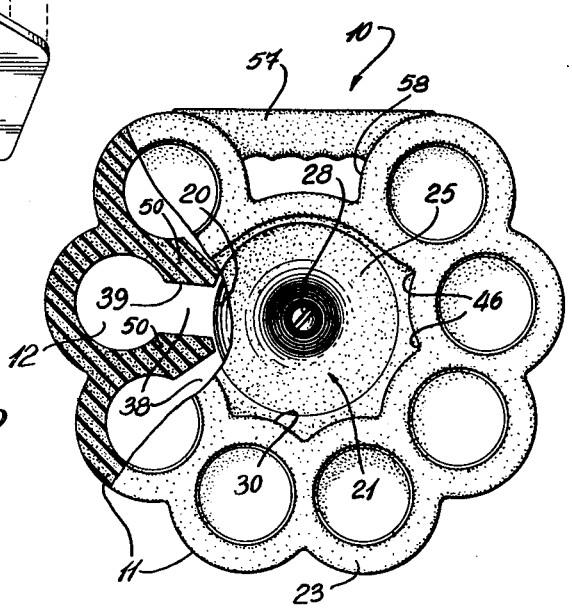
FIG. 2 is a rear view, partly fragmented, of the cooler.
Figure 3:
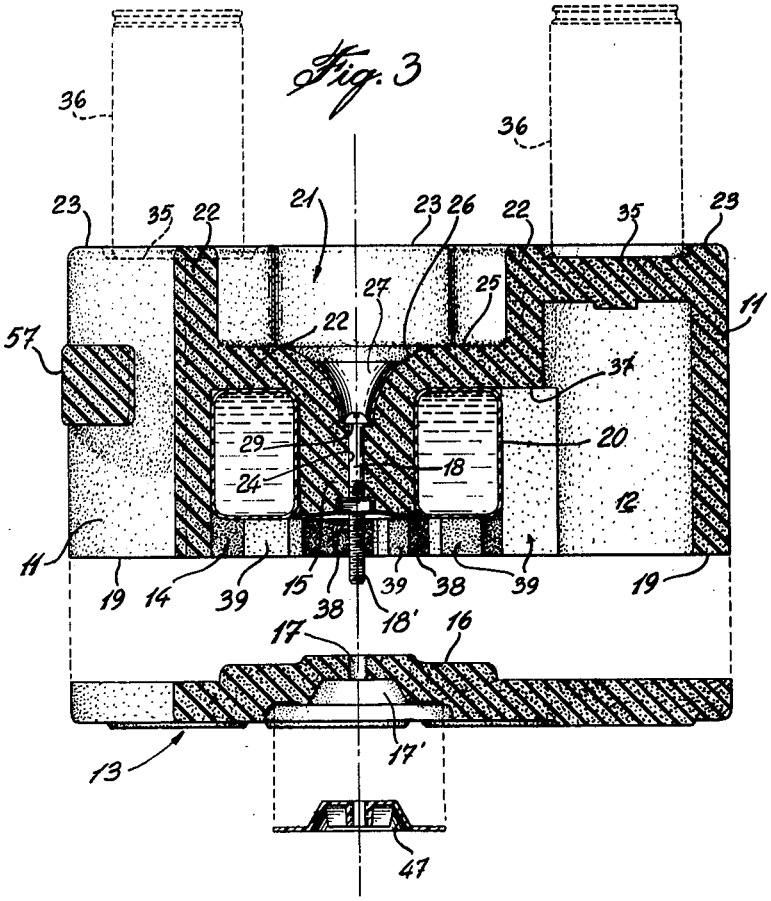
FIG. 3 is a side section view of the cooler in its position of use with the bottom wall constituting a support surface.

Referring now to the drawings and more particularly to FIGS. 1 to 3, there is shown generally at 10, the cooler of the present invention. The cooler comprises a first section or body 11 in which a plurality of cylindrical compartments 12 are formed. A second section or cover 13 is securable over the open end of the body 11 whereby the cylindrical compartments 12 are enclosed within the body 11. A plurality of these cylindrical compartments are arranged about a central chamber 14 which is formed within the body 11, and which is delineated about a pillar 15 formed integral with the body 11 and extending concentric with the axis of the central chamber 14.

In the present embodiment of the cooler, the cylindrical compartments are equidistantly spaced and arranged in a circle in the first section and the pillar extends at the center of this circle in the central chamber 14. The cover 13 is reinforced by an enlarged circular projection 16 which is guided within the top open area of the central chamber 14. A bore 17 extends through the center of the cover within a circular bushing-receiving cavity 17' to receive a securement screw fastener 18 therein. A bushing-like wing nut 47 is threaded on the free end 18' of the fastener 18 whereby the cover can be engaged over the top wall 19 of the body 11 with the pressure of the fastener distributed over the reinforced projection 16 not to damage or weaken the cover and to prevent leakage of cold air. Thus, the cylindrical compartments 12 are concealed within the cooler body and these are in communication with air refrigerated by a cold pack 20 which is located about the pillar 15.

In order to have access to the compartments 12, a recess 58 is provided in a peripheral area of the cover 13 whereby rotation of the cover about the screw fastener 18 will give access to the individual compartments 12 through the recess 58.

Referring again to FIGS. 1 to 3, a central cavity 21 is formed in the bottom wall 22 of the body 11 to define an opening in the outer bottom surface 23 of the cooler body. The pillar 15 is provided with a bore 24 which extends substantially at the center of the cavity 21 and which is adapted to receive the securement screw 18, previously mentioned. As hereinshown, the bottom wall 25 of the cavity 21 has a bushing-receiving recess 26 concentrically positioned with respect to the bore 24.

This recess is to receive a bushing 27 in close fit therein whereby to add rigidity to the pillar 15 in the area where the securement screw 18 is received. As shown, in FIG. 3, the flat shoulder under the head 28 of the screw 18 abuts the end wall 29 of the bushing 27 and thus distributes the tension in the screw 18 in the bushing 27 when the cover is placed on the body 11 and the wing nut 47 is tightened.

Figure 4:
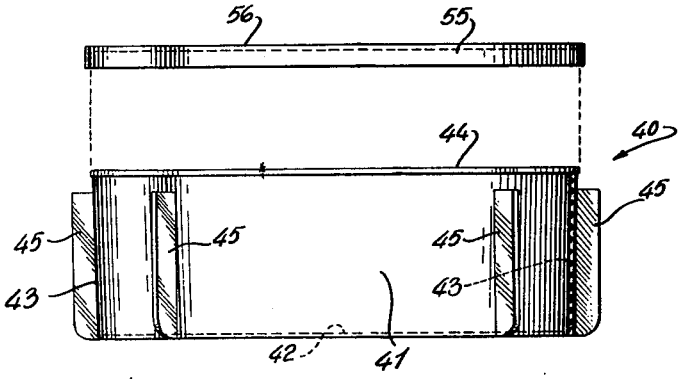
FIG. 4 is an exploded side view of the food receptacle with the cover removed.

Referring now more specifically to FIGS. 4 to 6, there is shown a food receptacle 40 which is adapted to be retained in the central cavity 21. The food receptacle 40 comprises a receptacle part 41 having a bottom wall 42, a side wall 43, and an open top end 44. A lid or cover 55 is removably securable about the open end 44 and frictionally held thereabout.

Retention means, herein provided in the form of retention ribs 45, are formed integral with the side walls 43 of the receptacle part 41. These ribs are utilized to frictionally retain the receptacle part in the central cavity. The securement is effected by dimensioning the cavity 21 to receive the ribs of the receptacle part in frictional engagement with recessed portions 46 the side wall 30 of the cavity 21. As shown in FIG. 5, there are four such retention ribs 45 located in the corners of the receptacle part 41 and extending transverse to the horizontal plane of the receptacle. These ribs also space the side wall 43 of the receptacle from the side wall 30 of the cavity whereby to permit finger engagement of the lid 55 to attach or detach the lid from the open end 44 of the container. Thus, it is not necessary to remove the container from the cavity each time the lid is to be removed for access to the foodstuff therein or to place the lid back on the receptacle.

As shown in FIG. 2, the recessed portions 46 in the cavity side wall 30 are delineated by arcuate side wall portions resulting in the formation of the cylindrical compartments 12. These recessed portions 46 orient the receptacle 40 to a desired position within the central cavity 21. The ribs and the recessed portions also prevent the receptacle from being displaced or rotated in its planar axis.

When the lid 55 is attached to the open end 44 of the receptacle, and the receptacle is secured in the cavity 21, the lid outer face 56 is flush with the bottom surface 23 of the cooler body 11 thus not providing obstruction for accidental detachment. The receptacle 40 and the cavity 21 are dimensioned whereby the receptacle 40 may carry two sandwiches 48, each not more than 1¼" thick. The lid 55 is molded from polyethylene material and the body part 41 is also molded from polyethylene material for good adherence between the lid and body to obtain a moisture proof seal.

Referring now to FIG. 6, there is shown a modification of the bottom wall 42 of the receptacle part 41. As herein shown, the retention means is constituted by the means for mounting the cover 13 on the body 11 and, namely, by the securement screw 18. The bottom wall 42 may be molded with a central bushing-like depression 53 having a hole 52 therein. The depression 53 has a flat bottom wall 51 into which the hole 52 is centrally located. The flat bottom wall 51 constitutes a shoulder portion about the hole whereby the head 28 of the fastener 18 will rest and provide retention of the receptacle within the cavity. A washer (not shown) may also be located over the flat bottom wall 51 under the head 28 to minimize wear of the material in this region.

Alternatively, the depression 53 may be molded for close fit within the recess 26 of FIG. 3 and the bushing 27 could be eliminated or received in the depression 53. This type of retention means provides a more positive retention of the receptacle and also makes the receptacle removably securable in the cavity 21. With such an arrangement, instead of guide ribs, the side wall 43 of the container may have a shape to localize itself within the cavity 21 in close contact with the side wall 30 of the cavity to prevent displacement of the receptacle within the cavity. Furthermore, the orientation of the receptacle could be achieved by giving the bushing-like depression 53 a predetermined shape and modifying the recess 26 in the bottom wall 25 of the cavity 21 to be of identical shape. Thus, the receptacle would only fit in one oriented direction within the cavity 21.

Referring now to FIGS. 1 and 2, it can be seen that the bottom surface 23 of the cooler body 11 is provided with circular indentation 35 concentric and adjacent each cylindrical compartment 12. These indentations serve as shallow receptacles to guide the bottom end of cylindrical beverage containers 36 when the cooler is placed upside down with the bottom surface 23 providing a tabletop-like support surface. With the lid 55 removed from the receptacle part 41 of the receptacle 40, the central portion of the support surface exposes the food (peanuts, sandwiches, etc.) whilst several beverage containers are securely supported on the surface 23. This is particularly advantageous when the cooler is used, for example, while on a picnic or at the beach and serves as a table. For example, when on a sandy surface, at a beach, where the surface is irregular and sand or other debris can easily get into the food, the elevated surface 23 protects the food from such substances. The cooler herein serves as a more sanitary type device for supporting food and beverages when eating outdoors.

Referring again to FIG. 3, there is shown the dimension of the cavity 21 with respect to the body portion of the cooler. As herein shown, the central chamber 14 which receives the cold pack 20 has a support surface 37 which extends substantially mid-way of the depth of the cylindrical compartments. The bottom wall 25 of the central cavity 21 is spaced a distance from the surface 37 defined by the thickness of the bottom wall 22. The cold pack 20 is in communication with the cylindrical compartments 12 through the openings or channels 38 defined by the space above the support wall 37 and between the channel side walls 39 delineated by the protrusion portions 50 of the side wall extending between the cylindrical compartments 12.

As also shown in FIG. 1, a carrying handle 57 is molded integrally with the body 11 and positioned at right angles to the central longitudinal axis of the cylindrical compartments 12. The handle is molded within the circumference of the cooler thereby eliminating any protrusions and reducing the size of the cooler.

Thus, there is provided a cooler which is compact, easily transportable, low cost and which provides for the storage of cylindrical-type beverage containers as well as provides an air-tight moisture-proof container to carry foodstuff and which may be alternatively used as a sanitary table-like support surface.

It is within the ambit of the present invention to cover any obvious modifications of the preferred embodiment described herein provided such modifications fall within the scope of the appended claims.

I claim:

1. A cooler comprising a first section and a second section, a plurality of spaced compartments arranged about a central chamber within said first section, each said compartment being in communication with said chamber, an access passage in said second section, means for mounting said second section on said first section, a pillar concentric with a central axis in said central chamber, a coolant container, an aperture in said coolant container, said coolant container being receivable in said central chamber with said pillar extending in said aperture, said first section having a central cavity in a bottom wall thereof to define a food receiving opening in its outer bottom surface.

2. A cooler as claimed in claim 1 wherein a food receptacle is retained in said central cavity; said receptacle having a receptacle part defined by a bottom wall, a side wall and an open top end; a lid for said open top end, and retention means to secure said receptacle part in said central cavity.

3. A cooler as claimed in claim 2 wherein said retention means is constituted by at least two retention ribs formed integral with said receptacle side wall, said ribs extending outwardly of said side wall to frictionally engage with a side wall of said cavity.

4. A cooler as claimed in claim 3 wherein said cavity is formed with recess portions in said side wall thereof, some of said recess portions receiving said at least two retention ribs whereby to orient said receptacle part in said cavity.

5. A cooler as claimed in claim 2 wherein said retention means is constituted by said means for mounting said second section, said means being a bolt-like fastener extending through a hole in said bottom wall of said receptacle part and into said pillar.

6. A cooler as claimed in claim 5 wherein said bolt-like fastener extends through said pillar, and means to removably engage a free end of said fastener to removably secure said second section on said first section.

7. A cooler as claimed in claim 5 wherein there is provided a recess in said bottom wall of said receptacle part, said hole being positioned in said recess, a flat shoulder portion about said hole, said rod-like fastener having a head at one end, said head having at least a portion thereof resting about said shoulder portion when said fastener extends through said hole.

8. A cooler as claimed in claim 5 wherein said side wall of said receptacle part is formed with at least one guide element, said guide element being localized within said cavity to position said receptacle in a predetermined position and to prevent planar displacement of said receptacle part when in said cavity.

9. A cooler as claimed in claim 8 wherein there is at least two of said guide elements, each guide element being a guide rib formed integral with said side wall of said receptacle part, said cavity being formed with recess portions in a side wall thereof, said recess portions receiving a respective one of said at least two retention ribs whereby to orient said receptacle part in said cavity.

10. A cooler as claimed in claim 1 wherein said bottom bottom surface of said first section constitutes a top support surface when said cooler is supported upside down, said opening being positioned substantially central of said bottom surface, and a plurality of spaced apart circular indentations about said cavity, each said indentations having a support surface area lying below said top support surface and dimensioned to receive a respective beverage receptacle in guided support thereon.

11. A cooler as claimed in claim 1 wherein said chamber defines a coolant container support surface extending substantially mid-way of the depth of said spaced compartments, said central cavity having a flat bottom wall spaced a distance from said mid-way point defined by the thickness of said bottom wall.

12. A cooler as claimed in claim 1 wherein said compartments are arranged in a circle in said first section about said central chamber, said second section being mounted for relative rotation with respect to said first section about said central axis of said central cavity.

13. A cooler as claimed in claim 2 wherein at least two opposed spaces are provided between said side wall of said cavity and said side wall of said receptacle part to permit removal and engagement of said lid about said open top end of said receptacle part.

* * * * *